US009332355B2

(12) United States Patent
Akino

(10) Patent No.: US 9,332,355 B2
(45) Date of Patent: May 3, 2016

(54) ELECTRO-ACOUSTIC TRANSDUCER

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 18 days.

(21) Appl. No.: 14/286,403

(22) Filed: May 23, 2014

(65) Prior Publication Data

US 2014/0369532 A1 Dec. 18, 2014

(30) Foreign Application Priority Data

Jun. 12, 2013 (JP) ..... 2013-123393

(51) Int. Cl.
*H04R 25/00* (2006.01)
*H04R 23/00* (2006.01)

(52) U.S. Cl.
CPC ..... *H04R 23/004* (2013.01)

(58) Field of Classification Search
CPC ..... H04R 3/00; H04R 23/004; H04R 19/01
USPC ..... 381/150, 167; 29/594
See application file for complete search history.

(56) References Cited

U.S. PATENT DOCUMENTS 4,482,788 A * 11/1984 Klein ..... 381/167

FOREIGN PATENT DOCUMENTS

JP 2010-183330 8/2010

* cited by examiner

*Primary Examiner* — Paul S Kim
*Assistant Examiner* — Norman Yu
(74) *Attorney, Agent, or Firm* — Whitham Curtis Christofferson & Cook, PC

(57) ABSTRACT

In an electro-acoustic transducer including a needle electrode and a counter electrode facing the needle electrode and inducing electric discharge between the needle electrode and the counter electrode for electro-acoustic conversion by an RF voltage applied across the needle electrode and the counter electrode, the counter electrode has a cylindrical surface surrounding plasma extending from the needle electrode and has a cutout in a part of the cylindrical surface. This configuration prevents a short circuit between the needle electrode and the counter electrode due to plasma.

8 Claims, 7 Drawing Sheets

ELECTRO-ACOUSTIC TRANSDUCER

TECHNICAL FIELD

The present invention relates to a diaphragm-free electro-acoustic transducer with an RF discharge scheme.

BACKGROUND ART

Standard electro-acoustic transducers, such as microphones and speakers convert mechanical vibrations of diaphragms into electric signals. Microphones sense vibrations of a diaphragm in response to sound waves in the form of, for example, variations in electromagnetic property, electrostatic capacity, or opto-electric property to convert the variation into electrical signals. Common speakers electromagnetically convert audio signals into vibrations of a diaphragm and emit sound waves. The diaphragms of these electro-acoustic transducers are used to convert air vibrations into electrical signals and to convert electrical signals into air vibrations.

Control schemes for electro-acoustic transducers based on machine vibration systems provided with diaphragms includes a mass control, a resistance control, and an elastic control. The resonant frequencies of a diaphragm are designed to be located near the lower limit, at the center, and near the upper limit of the main frequency band. Conventional electro-acoustic transducers with diaphragms, which have been commonly used, in particular microphones have a limited frequency response due to the existence of the diaphragms in any control scheme. Even if the mass of the diaphragm is reduced to the utmost, the remaining mass causes inertia force leading to limited sound collection in some frequency.

Diaphragm-free electro-acoustic transducers have been investigated to solve such a limitation. As an example production of such investigations, Japanese Unexamined Patent Application Publication No. 55-140400 discloses a method for detecting the velocity of particles generated by electric discharge and electro-acoustically converting the velocity. In this disclosure, a counter electrode interspatially surrounds a needle electric discharge electrode. The counter electrode is composed of a sphere conductive material having holes for transmitting sound waves. The electric discharge electrode extends to the interior of the spherical counter electrode and reaches the substantial center of the sphere. RF voltage signals are applied to the electric discharge electrode from an RF voltage generating circuit. This RF voltage signals are modulated with low frequency signals to be converted into sound waves in the RF voltage generating circuit. Corona discharge in response to the RF voltage signals occurs between the electric discharge electrode and the counter electrode to emit the low frequency signals, i.e., sound waves.

The invention described in Japanese Unexamined Patent Application Publication No. 55-140400 relates to an ionic speaker and is not assumed to be used as a microphone. The present inventor had proposed a microphone which can convert sound waves into electrical signals by electric discharge (see Japanese Unexamined Patent Application Publication No. 2010-183330).

The microphone described in Japanese Unexamined Patent Application Publication No. 2010-183330 includes needle electrode, a counter electrode facing the needle electrode, an electric discharger provided between the needle electrode and the counter electrode, an RF oscillation circuit including the electric discharger and generating RF electric discharge in the electric discharger, a sound wave guide introducing sound waves into the electric discharger, and a modulation signal output terminal extracting signals modulated in response to sound waves oscillated in the RF oscillation circuit and introduced into the electric discharger. The RF oscillation circuit RF-oscillates at the electric discharger as a feedback path between the needle electrode and the counter electrode. The electric discharge unit discharges RF waves. The equivalent impedance of the electric discharger then varies in response to sound waves and is frequency-modulated. Sound waves, i.e., audio signals is obtained by demodulating the frequency-modulated signals.

Examples of electro-acoustic transducers with an RF electric discharge scheme as described in Japanese Unexamined Patent Application Publications Nos. 55-140400 and 2010-183330 include ionic speakers (ionic tweeters). The technique described in Japanese Unexamined Patent Application Publication No. 2010-183330 can be applied to ionic microphones. According to Japanese Unexamined Patent Application Publication No. 2010-183330, an RF voltage is applied between the needle electrode and the counter electrode facing each other to generate from the tip of the needle electrode plasma toward the counter electrode. The plasma is generated like a flame from the needle electrode toward the counter electrode and may therefore be called an electric discharge flame. The needle electrode in contact with the plasma has a high temperature.

It was found that a cylindrical electrode facing the needle electrode, instead of a plate electrode, can enhance the sensitivity of the electro-acoustic transducer. The sensitivity of the electro-acoustic transducer can also be enhanced by increasing electric discharge power. Excess electric discharge power however causes a transition to spark discharge between the electrodes to cause a substantial short circuit. In consequence, these traditional techniques are not suitable for electro-acoustic transducers. The structure of the cylindrical electrode facing and surrounding the needle electrode, as described above readily generates spark discharge. The reason will be explained below.

FIG. 8 illustrates a typical conventional electro-acoustic transducer with RF electric discharge. In FIG. 8, the counter electrode 4 facing the needle electrode 3 has a cylindrical shape. The tip of the needle electrode 3 is adjacent to and continuous with the counter electrode 4 in the direction of the central axis of the needle electrode 3 and the counter electrode 4. The needle electrode 3 and the counter electrode 4 have the common central axis. As seen in the direction of the central axis of the needle electrode 3 and the counter electrode 4, the counter electrode 4 surrounds the outer circumference of the needle electrode 3 with a predetermined gap. The base of the needle electrode 3 is covered with an insulating cylinder 5. The insulating cylinder 5 is further fit into an insulating cylinder 6. The insulating cylinder 6 penetrates across the thickness of a disk base 1 and is fixed with the base 1.

The outer circumference of the base 1 is fit into the inner circumference at one end of the cylindrical case 2. The case 2 extends from the outer surface of the base 1 along the needle electrode 3. The needle electrode 3 extends through the space defined by the case 2 substantially on the central axis of the case 2. The opposite end of the case 2 to the fixed base 1 is open. This opening end has an inner circumference fit into the outer circumference of the counter electrode 4. The counter electrode 4 is thereby fixed on the case 2.

An RF voltage is applied to the needle electrode 3 from a driver 7 including, for example, an RF oscillation circuit. The needle electrode 3 and the counter electrode 4 define an electric discharger. An RF voltage is applied to the electric discharger to discharge RF waves in the electric discharger.

The electric discharge is called torch discharge. FIG. 8 illustrates an electric discharge flame 8, i.e., plasma, generated by electric discharge in the electric discharger.

An electro-acoustic transducer is usually placed such that sound waves enter or emit in a lateral direction. In other words, an electro-acoustic transducer is used on an appropriately upward or downward slant from a horizontal state if necessary. FIG. 8 illustrates a normal state of the electro-acoustic transducer. The electro-acoustic transducer is positioned such that sound waves enter from the left or emit to the left. The plasma 8 is gas containing charged particles generated by ionization and has a high temperature. If the electro-acoustic transducer is positioned laterally as illustrated in FIG. 8, the plasma 8, which is hot gas, extends from the tip of the needle electrode 3 along the central axis of the counter electrode 4. In use, the tip of the plasma 8 curves upward due to the temperature rise.

The counter electrode 4 has a cylindrical shape. When the tip of the plasma 8 curves upward as illustrated in FIG. 8, the plasma 8 may reach the counter electrode 4. The plasma 8 reaching the counter electrode 4 leads to the transition from plasma electric discharge to spark discharge. The spark discharge is equivalent to a short circuit between the needle electrode 3 and the counter electrode 4 and disables the electro-acoustic conversion. This technical problem was found by a cylindrical counter electrode 4 provided to enhance the sensitivity of the electro-acoustic transducer. An increase in an RF voltage applied to the needle electrode 3 can enhance the sensitivity of the electro-acoustic transducer. Such a configuration however causes an increase in the size and the curve of the tip of plasma 8 and readily leads to a short circuit between the needle electrode 3 and the counter electrode 4.

In order to prevent the influence of the above technical problem as illustrated in FIG. 9, the electro-acoustic transducer may be positioned upright along a vertical central axis. The needle electrode 3 is positioned upright in the vertical direction, and the plasma 8 vertically extends from the tip of the needle electrode 3 without distortion. The shape of the plasma 8 does not change at this attitude even if the temperature rises. The counter electrode 4 surrounds the plasma 8 with a predetermined gap from the circumference of the plasma 8.

According to the electro-acoustic transducer as illustrated in FIG. 9, no short circuit occurs between the needle electrode 3 and the cylindrical counter electrode 4 even for a higher RF voltage applied to the needle electrode 3 and a larger plasma 8. Unfortunately, electro-acoustic transducers, i.e., microphones and speakers are rarely used upright as illustrated in FIG. 9. In use as a microphone in particular, sound should be applied to the electro-acoustic transducer from right above toward right below, and this leads to the influence of a high temperature of the plasma 8. It has therefore been required to provide a structure not causing a short circuit between the needle electrode 3 and the counter electrode 4 due to the plasma 8 even in the lateral position in use as illustrated in FIG. 8.

SUMMARY OF INVENTION

Technical Problem

It is an object of the present invention to prevent a short circuit between a needle electrode and a cylindrical counter electrode due to plasma in an electro-acoustic transducer with RF electric discharge including the needle electrode and the counter electrode.

Solution to Problem

According to an aspect of the present invention, an electro-acoustic transducer includes a needle electrode and a counter electrode facing the needle electrode and inducing electric discharge between the needle electrode and the counter electrode for electro-acoustic conversion by an RF voltage applied across the needle electrode and the counter electrode, and the counter electrode has a cylindrical surface surrounding plasma extending from the needle electrode and has a cutout in a part of the cylindrical surface.

Advantageous Effects of Invention

If the electro-acoustic transducer in use is positioned laterally, the tip of the plasma extending from the needle electrode curves upward. The electro-acoustic transducer is placed such that the cutout of the counter electrode corresponds to the curving position of the plasma. Even if the tip of the plasma curves upward, the tip of the plasma is downward attracted due to a smaller electric field in the cutout than that in the other area, which can prevent the plasma from reaching the counter electrode. This configuration can prevent a short circuit between the needle electrode and the counter electrode.

DESCRIPTION OF EMBODIMENTS

Figure 8:
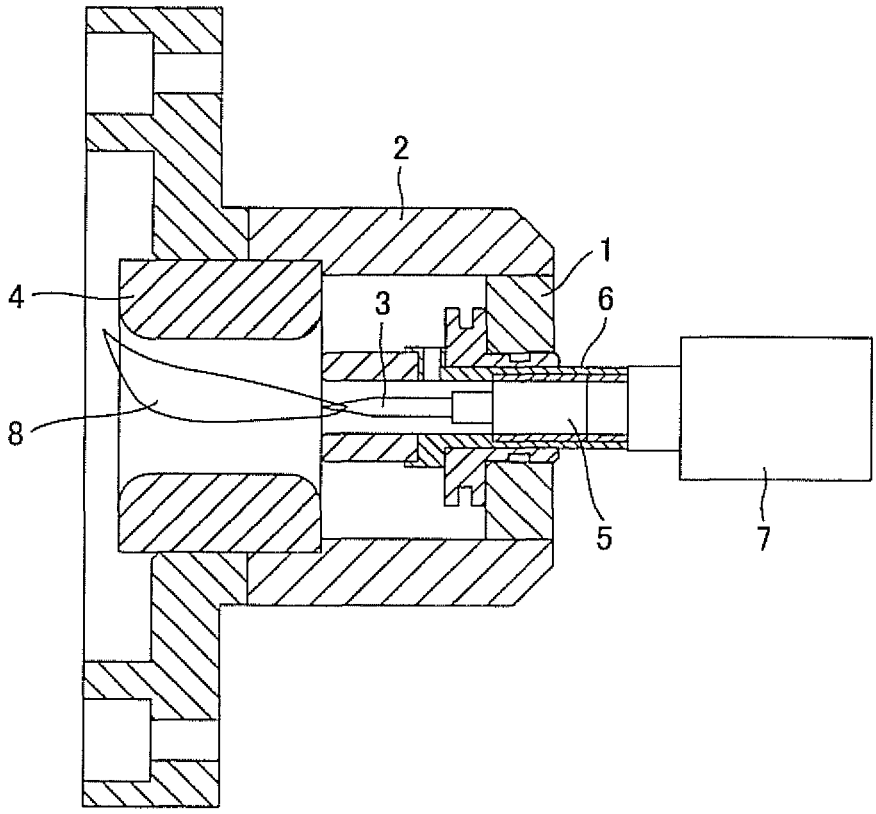
FIG. 8 Related Art
FIG. 8 is a longitudinal cross-sectional view of a typical conventional electro-acoustic transducer with an RF electric discharge scheme.
Figure 9:
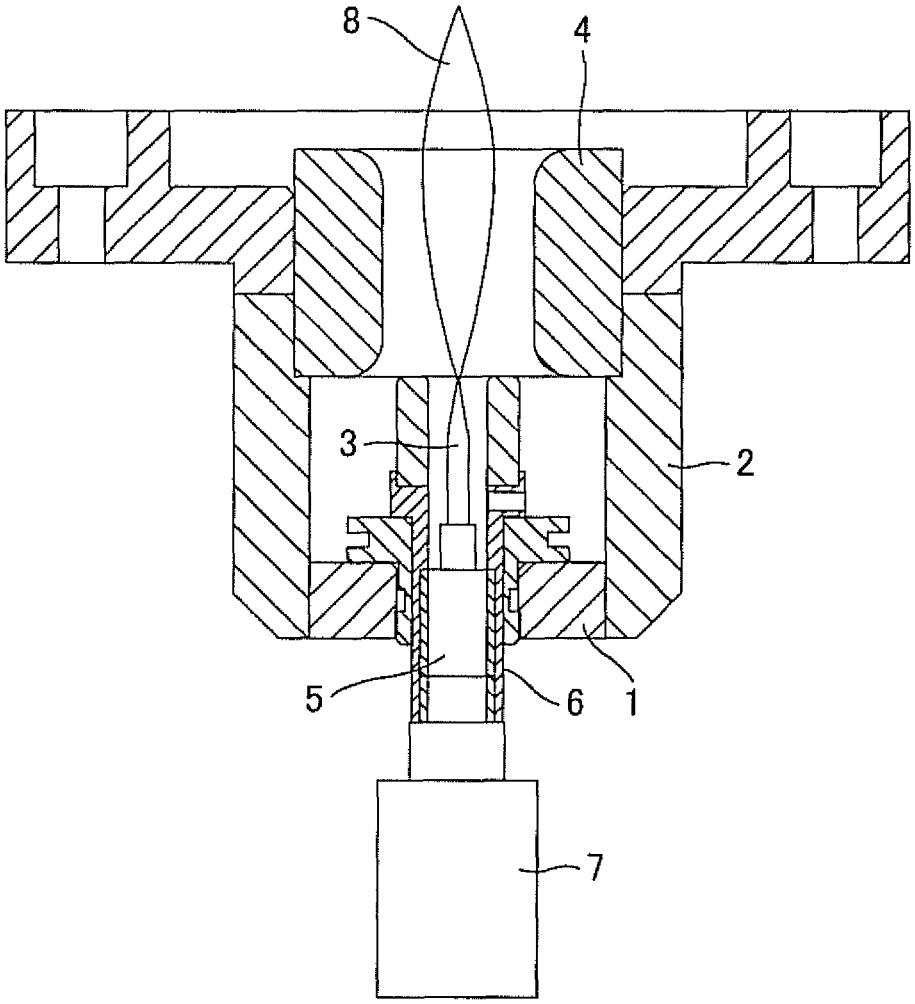
FIG. 9 Related Art
FIG. 9 is a longitudinal cross-sectional view of the typical conventional electro-acoustic transducer in another attitude.

An electro-acoustic transducer in an embodiment of the present invention will now be described with reference to the accompanying drawings. Identical components with those of the typical known unit in FIGS. 8 and 9 are designated with identical reference numerals.

Embodiments

Embodiment 1

Figure 1:
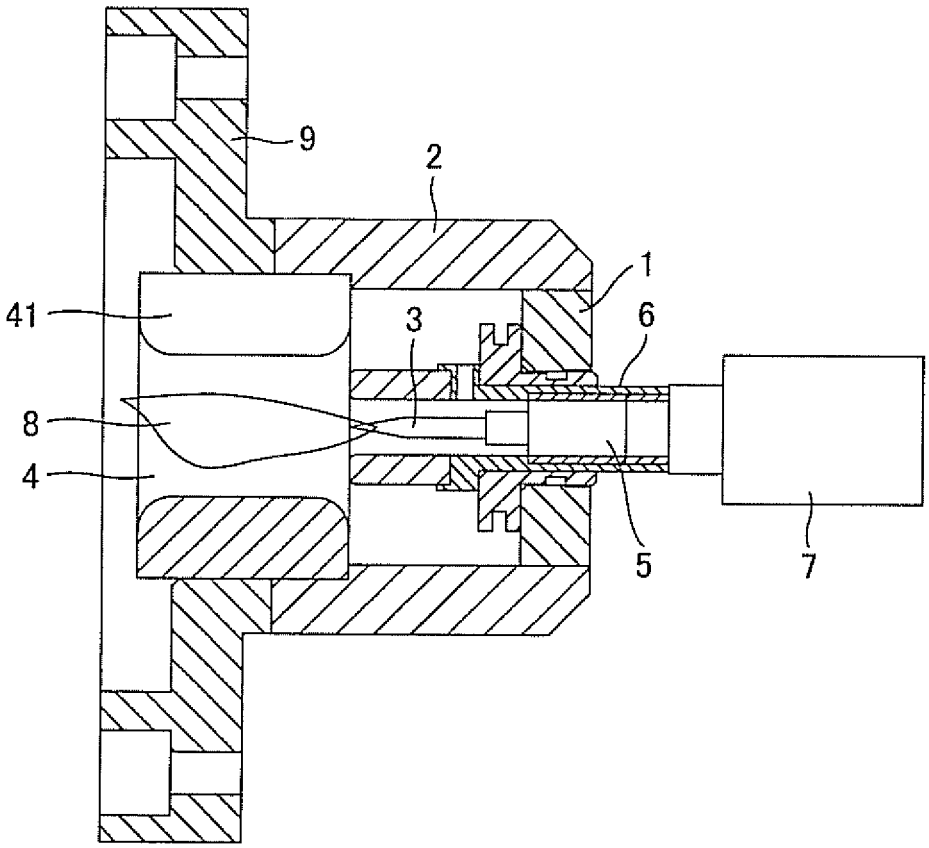
FIG. 1 is a longitudinal cross-sectional view illustrating an electro-acoustic transducer according to an embodiment of the present invention.
Figure 2:
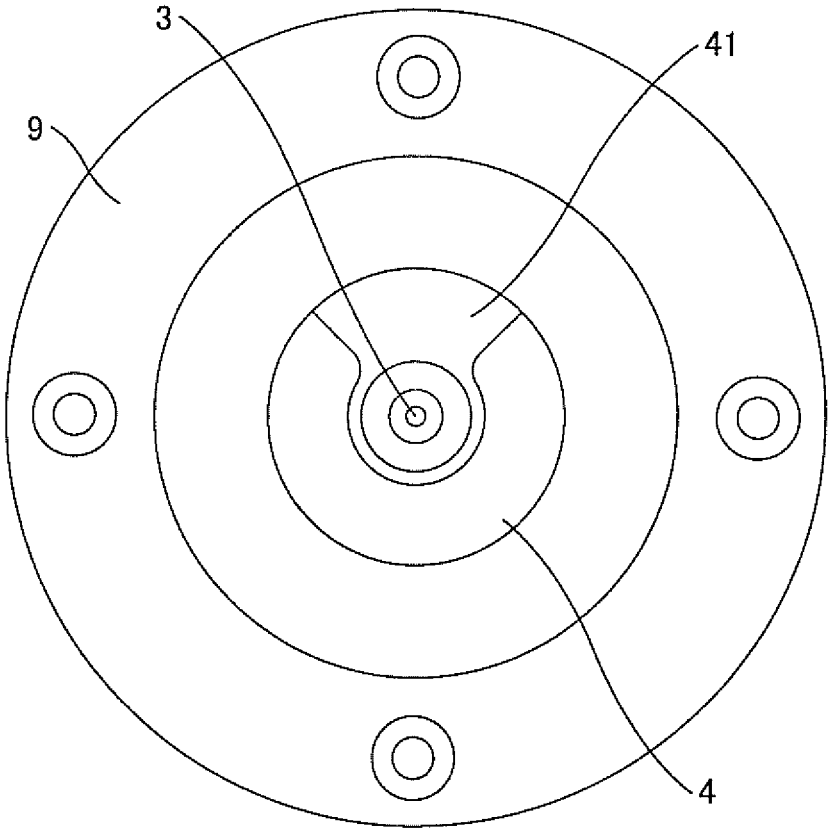
FIG. 2 is a front view of the embodiment.

In FIGS. 1 and 2, reference numerals 3 and 4 represent a needle electrode and a counter electrode, respectively. The needle electrode 3 is a metallic (for example, tungsten) rod having a round cross section. The needle electrode 3 is shaped by sharpening the tip of the rod. The counter electrode 4 facing the needle electrode 3 is composed of a material such as stainless steel. The counter electrode 4 has a substantially cylindrical shape. The tip of the needle electrode 3 is adjacent to and continuous with the counter electrode 4 in the direction of the central axis of the needle electrode 3 and the counter electrode 4. As seen in the direction of the central axis of the needle electrode 3 and the counter electrode 4, the electrodes have the common central axis. That is, the needle electrode 3 is located on the central axis of the cylindrical surface of the counter electrode 4. As seen in the direction of the central axis, the counter electrode 4 surrounds the outer circumference of the needle electrode 3 with a predetermined gap.

The base of the needle electrode 3 is covered with an insulating cylinder 5. The insulating cylinder 5 is further fit into an insulating cylinder 6. The insulating cylinder 6 penetrates across the thickness of a disk base 1 and is fixed with the base 1. The outer circumference of the base 1 is fit into the inner circumference at one end of the cylindrical case 2. The case 2 extends from the outer surface of the base 1 along the needle electrode 3. The needle electrode 3 extends through the space defined by the case 2 substantially on the central axis of the case 2. The opposite end of the case 2 to the fixed base 1 is open. This opening end has an inner circumference fit into the outer circumference of the counter electrode 4. The counter electrode 4 is thereby fixed on the case 2.

The present embodiment is different from the typical known examples illustrated in FIGS. 8 and 9 in that the counter electrode 4 has a partial cutout 41. The counter electrode 4 is a cylinder provided with the cutout 41 to enhance the sensitivity of the electro-acoustic transducer. The cylindrical counter electrode 4 is partially cut out along a line parallel to the central axis and is partially open in the circumferential direction. This open portion is the cutout 41. The cutout 41 is provided in the counter electrode 4 to distribute an electric field between the needle electrode 3 and the counter electrode 4 such that the electric field in the cutout 41 is smaller than that in the other area. The cutout 41 is provided along the entire length, i.e., the central axial direction of the counter electrode 4.

Since the plasma 8 curves upward at the tip of the plasma 8, the cutout 41 may be provided only in a portion corresponding to the tip of the plasma 8. That is, the cutout 41 may be provided only in the left end of the counter electrode 4 in FIG. 1.

An RF voltage is applied to the needle electrode 3 from a driver 7 including, for example, an RF oscillation circuit. The needle electrode 3 and the counter electrode 4 define an electric discharger. An RF voltage is applied to the electric discharger to discharge RF waves in the electric discharger. The electric discharge is called torch discharge. FIG. 1 illustrates an electric discharge flame 8, i.e., plasma, occurring during electric discharge in the electric discharger. The counter electrode 4 has a cylindrical surface surrounding the plasma 8 extending from the needle electrode 3. The cutout 41 is provided in a part of the cylindrical surface.

As described above, an electro-acoustic transducer is usually used in a horizontal attitude in which sound waves enter or emit in a lateral direction. Alternatively, the electro-acoustic transducer is used with an appropriately upward or downward slant attitude from the horizontal state if necessary. FIG. 1 illustrates a normal state of the electro acoustic transducer. In this state, sound waves enter or exit the left.

The plasma 8 is hot gas and extends from the tip of the needle electrode 3 along the central axis of the counter electrode 4. If the electro-acoustic transducer is positioned laterally, the tip of the extending plasma 8 tends to curve upward due to the temperature rise. The electro-acoustic transducer is therefore placed such that the cutout 41 of the counter electrode 4 is located in the direction of the curved plasma 8. That is, the electro-acoustic transducer is placed such that the upper portion of the counter electrode 4 is opened by the cutout 41. Therefore, when the needle electrode 3 and the counter electrode 4 are oriented horizontally, the electrodes 3 and 4 are placed such that the cutout 41 of the counter electrode 4 is located on the upper portion in the vertical direction.

When the electro-acoustic transducer is placed as described above to generate the plasma 8 from the needle electrode 3 towards the counter electrode 4, the tip of the plasma 8 tends to curve upward due to the temperature rise. Since the upper portion of the counter electrode 4 is opened at the cutout 41, an electric field between the needle electrode 3 and the counter electrode 4 is distributed such that an electric field in the cutout 41 is smaller than that in the other area. Such an electric field distribution leads to larger downward attractive force acting on the plasma 8 than upward attractive force acting on the plasma 8. The plasma 8 tending to rise due to the temperature rise is downward attracted by the counter electrode. As a result, the plasma 8 has a substantially uniform shape with a reduced curvature as illustrated in FIG. 1.

The electro-acoustic transducer using RF electric discharge according to Embodiment 1 is placed such that the cutout 41 of the counter electrode 4 is located on the upper portion. This configuration can reduce upward curving of the plasma 8 due to the temperature rise. As a result, the transition of the plasma 8 to spark discharge causing a short circuit between the needle electrode 3 and the counter electrode 4 can be prevented even if a higher RF voltage is applied across the needle electrode 3 and the counter electrode 4 to enhance the sensitivity.

Figure 3:
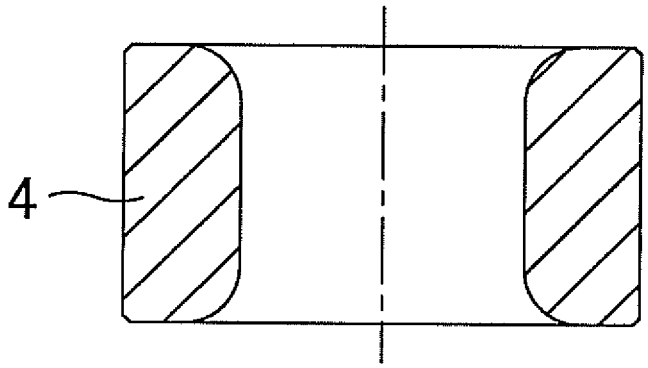
FIG. 3 is a longitudinal cross-sectional view illustrating a counter electrode in the embodiment.
Figure 4:
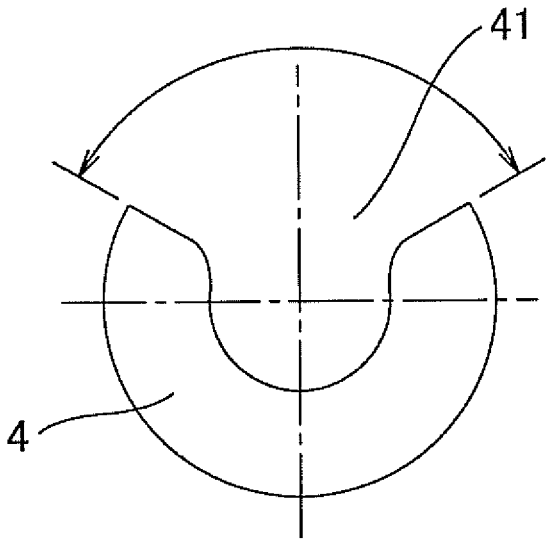
FIG. 4 is a front view of the counter electrode.
Figure 5:
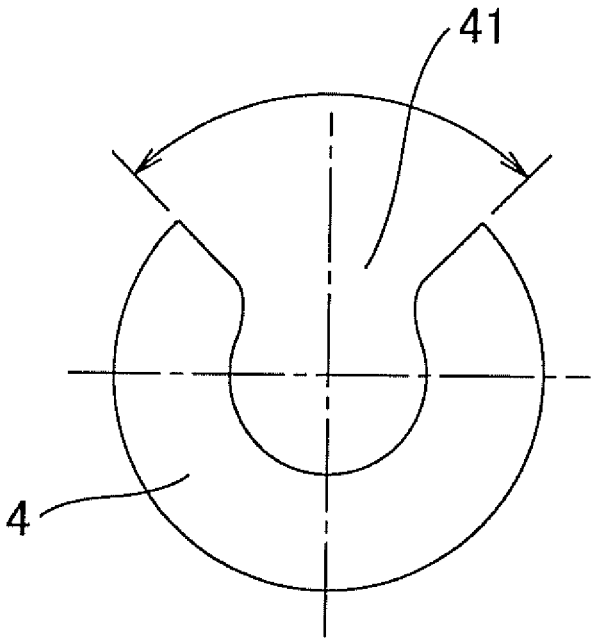
FIG. 5 is a front view illustrating another exemplary counter electrode applicable to the present invention.

The opening angle of the cutout 41 of the counter electrode 4 as seen in the central axis may appropriately be determined on the basis of the design specification. FIGS. 3 and 4 illustrate an example cutout 41 having an opening angle of about 120 degrees. FIG. 5 illustrates an example cutout 41 having an opening angle of about 90 degrees. The cutout 41 having an opening angle equal to or more than 90 degrees can certainly prevent upward curving of the plasma 8 due to the temperature rise.

Embodiment 2

In Embodiment 1, the cylindrical counter electrode 4 is partially cut out along a line parallel to the central axis and is partially open in the circumferential direction to provide the cutout 41. The counter electrode may however not be partially open in the circumferential direction, provided that the electric field in the cutout of the cylindrical counter electrode is smaller than that in the other area.

Figure 6:
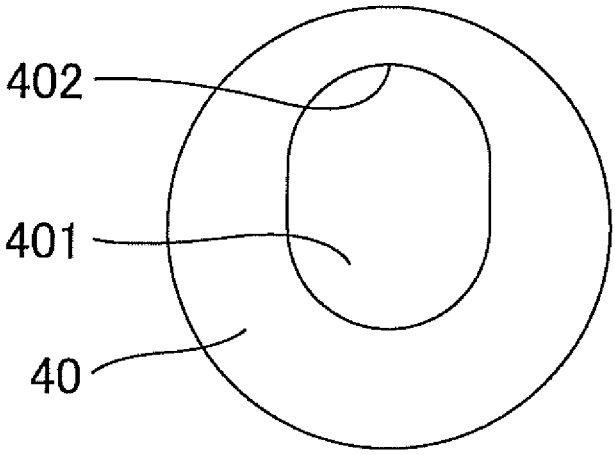
FIG. 6 is a front view illustrating still another exemplary counter electrode applicable to the present invention.
Figure 7:
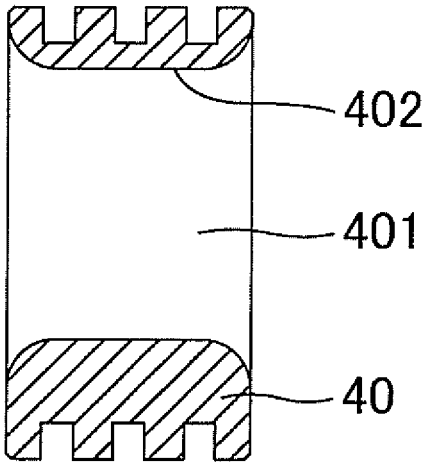
FIG. 7 is a longitudinal cross-sectional view of the counter electrode illustrated in FIG. 6.

FIGS. 6 and 7 illustrate Embodiment 2 providing a cutout in the counter electrode without a partial opening in the circumferential direction of the counter electrode. The electric field in the cutout is smaller than that in the other area. In FIGS. 6 and 7, a reference numeral 40 represents a counter electrode. The substantially cylindrical counter electrode 40 has a round cross section and a cavity 401. The cavity 401, i.e., the interior of the counter electrode 40 partially expands outward in the radial direction, and the expanding area serves as the cutout 402.

The substantial semicircle of the cavity 401 expands outward in the radial direction and serves as the cutout 402. The counter electrode 40 at the cutout 402 has a smaller thickness than that in the other area. In other words, the cavity of the cylindrical counter electrode 40 has an elliptic cross section shifted from the center of the counter electrode 40. The cutout 402 is provided along the entire length in the central axial direction of the counter electrode 40. Also in this embodiment, the cutout 402 may be provided only in a portion corresponding to the tip of the plasma 8, i.e., the front end (left end in FIG. 1) of the counter electrode 4.

Like the embodiment illustrated in FIG. 1, the counter electrode 40 has an outer circumference fit into the inner circumference at the tip of the cylindrical case 2. The components other than the counter electrode 40 are the same as those in the embodiment illustrated in FIG. 1. The position of counter electrode 40 relative to the needle electrode 3 is the same as that in the embodiment in FIG. 1. The electro-acoustic transducer according to Embodiment 2 can also be used in the lateral attitude as illustrated in FIG. 1. In this case, the cutout 402 of the counter electrode 40 is placed at the upper portion of the counter electrode 40.

In this state, an RF voltage applied across the needle electrode 3 and the counter electrode 40 induces RF electric discharge in an electric discharger defined by the needle electrode 3 and the counter electrode 40 to generate an electric discharge flame, i.e., plasma. The counter electrode 40 has a cylindrical surface surrounding the plasma extending from the needle electrode 3, and has the cutout 402 provided in a part of the cylindrical surface. If the electro-acoustic transducer is positioned laterally, the plasma, which is hot gas, from the tip of the needle electrode will curve upward due to the temperature rise. In the electro-acoustic transducer, the cutout 402 of the counter electrode 40 is placed in the direction of the curving plasma. This structure ensures a distance between the counter electrode 40 and the curving plasma.

An electric field between the needle electrode and the counter electrode 40 is distributed such that the electric field in the cutout 402 is smaller than that in the other area. Such an electric field distribution leads to larger downward attractive force acting on the plasma than upward attractive force acting on the plasma. The upward curving plasma due to the temperature rise is therefore attracted downward. As a result, the plasma has a substantially uniform shape like the embodiment illustrated in FIG. 1.

The counter electrode 40 according to Embodiment 2 has the cutout 402. This configuration can prevent the transition of the plasma generated between the needle electrode and the counter electrode 40 to spark discharge even if the counter electrode 40 facing the needle electrode has a cylindrical shape. The transition of the plasma to spark discharge can also be prevented even if a higher RF voltage is applied across the needle electrode and the counter electrode 40 to enhance the sensitivity.

The electro-acoustic transducer according to the present invention can be used as a microphone or a speaker and also as an instrument for measuring, for example, movement of, vibrations of, or a variation in air. In particular, a mechanical diaphragm is unnecessary, and the electro-acoustic transducer with no mechanical diaphragm is useful as a measuring instrument under severe conditions.

What is claimed is:

1. An electro-acoustic transducer comprising a needle electrode and a counter electrode facing the needle electrode and inducing electric discharge between the needle electrode and the counter electrode for electro-acoustic conversion by an RF voltage applied across the needle electrode and the counter electrode and by forming a plasma plume from the needle electrode, wherein the counter electrode has a substantial cylindrical shape and a cylindrical surface with a length extending in an axial direction so as to surround the plasma plume extending from the needle electrode and has a cutout in a part of the cylindrical surface, wherein the needle electrode and the counter electrode are oriented horizontally and are placed such that the cutout of the counter electrode is located on an upper portion of the counter electrode in a vertical direction.

2. The electro-acoustic transducer according to claim 1, wherein the counter electrode is partially cut out along a line parallel to a central axis, and is partially opened in a circumferential direction to serve as the cutout.

3. The electro-acoustic transducer according to claim 1, wherein the counter electrode an interior of the counter electrode partially expands outward in a radial direction to serve as the cutout.

4. The electro-acoustic transducer according to claim 1, wherein the counter electrode is continuous with the needle electrode in a direction of a central axis.

5. The electro-acoustic transducer according to claim 1, wherein the needle electrode is located on a central axis of a cylindrical surface of the counter electrode.

6. An electro-acoustic transducer comprising a needle electrode and a counter electrode facing the needle electrode and inducing electric discharge between the needle electrode and the counter electrode for electro-acoustic conversion by an RF voltage applied across the needle electrode and the counter electrode and by forming a plasma plume from the needle electrode, wherein the counter electrode has a substantial cylindrical shape and a cavity with a length extending in an axial direction so as to surround the plasma plume extending from the needle electrode, wherein the cavity has an expanding area which expands partially outward in the radial direction and, the expanding area has a smaller thickness than that in an other area of the counter electrode.

7. An electro-acoustic transducer comprising a needle electrode and a counter electrode facing the needle electrode and inducing electric discharge between the needle electrode and the counter electrode for electro-acoustic conversion by an RF voltage applied across the needle electrode and the counter electrode and by forming a plasma plume from the needle electrode, wherein the counter electrode has a substantial cylindrical shape and a cavity with a length extending in an axial direction so as to surround the plasma plume extending from the needle electrode, wherein the cavity is provided an elliptic cross section shifted from the center of the counter electrode.

8. The electro-acoustic transducer according to claim 3, wherein the cutout has an opening angle equal or more than 90 degrees.

* * * * *